US006883420B2

(12) United States Patent
Kuttalek

(10) Patent No.: US 6,883,420 B2
(45) Date of Patent: Apr. 26, 2005

(54) RAISED-LEVEL BUILT-IN COOKING APPLIANCE

(75) Inventor: Edmund Kuttalek, Grassau (DE)

(73) Assignee: BSH Bosch und Siemens Hausgerate GmbH, Munich (DE)

( * ) Notice: Subject to any disclaimer, the term of this patent is extended or adjusted under 35 U.S.C. 154(b) by 0 days.

(21) Appl. No.: 10/880,268

(22) Filed: Jun. 28, 2004

(65) Prior Publication Data

US 2004/0231524 A1 Nov. 25, 2004

Related U.S. Application Data

(63) Continuation of application No. PCT/EP02/13666, filed on Dec. 3, 2002.

(30) Foreign Application Priority Data

Dec. 27, 2001 (DE) ..... 101 64 237

(51) Int. Cl.[7] ..... A23L 1/00; F24C 15/16

(52) U.S. Cl. ..... 99/334; 99/339; 99/340; 99/427; 99/448; 126/273 A; 126/334

(58) Field of Search ..... 99/327–334, 337, 99/339, 338, 340, 357, 352–355, 426–427, 444–450, 467, 476, 481, 482; 219/398, 753, 403, 404, 762, 763, 391; 126/334, 339, 273 A, 340, 337 R, 19 PR, 332, 37 B, 190, 192; 312/272, 300, 247, 319.2; 266/253; 74/116

(56) References Cited

U.S. PATENT DOCUMENTS

| | | | | | |
|---|---|---|---|---|---|
| 1,921,690 | A | * | 8/1933 | Miller | 99/340 X |
| 2,382,354 | A | * | 8/1945 | Wales | 312/247 |
| 2,889,442 | A | | 6/1959 | Schultz | |
| 2,944,540 | A | | 7/1960 | Littell, Jr. | |
| 2,987,363 | A | * | 6/1961 | Morse | 99/357 X |
| 3,330,612 | A | * | 7/1967 | Masterson et al. | 312/290 |
| 3,390,930 | A | * | 7/1968 | Peterson | 312/269 |
| 4,074,963 | A | * | 2/1978 | Walsh | 99/340 X |
| 4,584,890 | A | * | 4/1986 | Chevrollier | 99/334 X |
| 5,029,935 | A | * | 7/1991 | Dufrancatel | 296/156 |
| 6,073,624 | A | | 6/2000 | Laurent | |

FOREIGN PATENT DOCUMENTS

| | | |
|---|---|---|
| WO | 98/04871 | 2/1998 |
| WO | 02/44622 A1 | 6/2002 |

* cited by examiner

*Primary Examiner*—Timothy F. Simone
(74) *Attorney, Agent, or Firm*—Laurence A. Greenberg; Werner H. Stemer; Ralph E. Locher

(57) ABSTRACT

A wall-mounted cooking appliance has a muffle and a bottom opening that can be closed by a lowerable bottom door. A drive mechanism is provided for lifting the bottom door. To prevent the jamming of objects that have been inadvertently placed below the base door, the novel wall-mounted cooking appliance has a control unit that detects an angle of inclination of the base door and controls the drive device in accordance with the magnitude of the angle of inclination to reduce the latter.

9 Claims, 8 Drawing Sheets

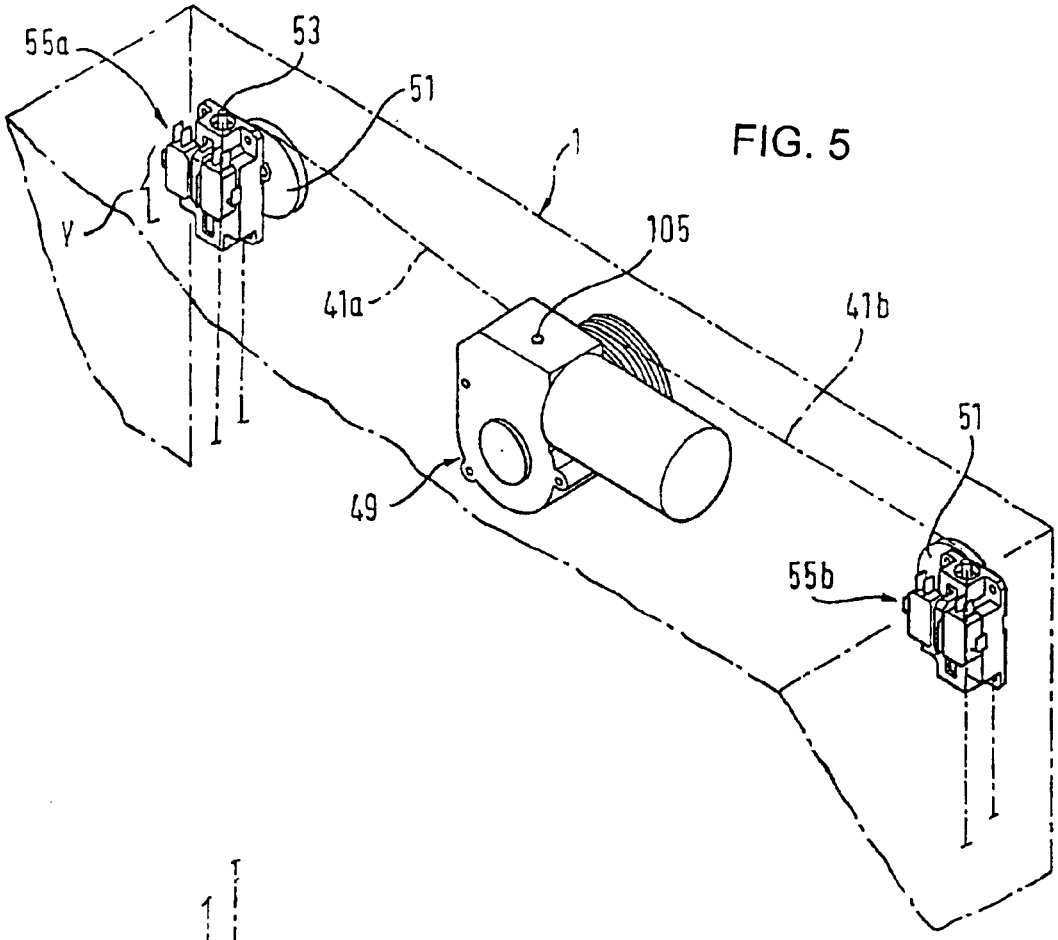
FIG. 5
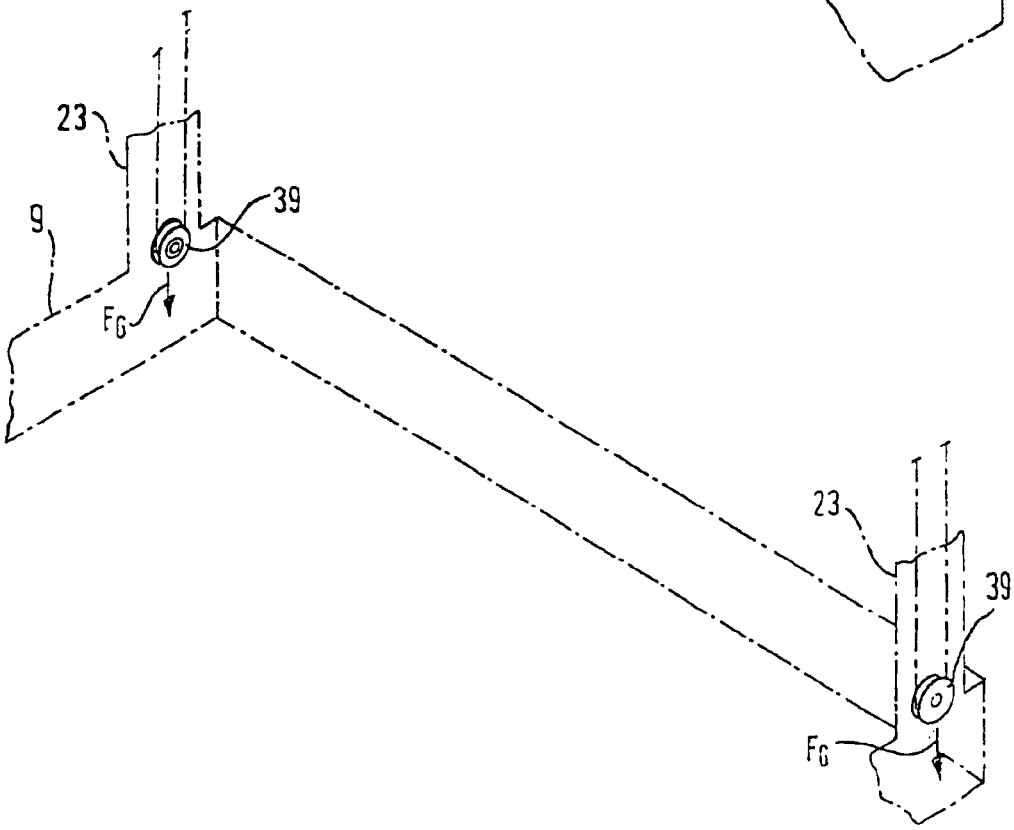

RAISED-LEVEL BUILT-IN COOKING APPLIANCE

CROSS-REFERENCE TO RELATED APPLICATION

This application is a continuation, under 35 U.S.C. § 120, of copending international application No. PCT/EP02/13666, filed Dec. 3, 2002, which designated the United States; this application also claims the priority, under 35 U.S.C. § 119, of German patent application No. 101 64 237.7, filed Dec. 27, 2001; the prior applications are herewith incorporated by reference in their entirety.

BACKGROUND OF THE INVENTION

Field of the Invention

The present invention relates to a raised-level built-in cooking appliance with a muffle, which has a floor-side muffle opening that can be closed with a lowerable bottom door, and which has a drive mechanism for lifting the bottom door.

A wall-mounted oven described in international PCT publication WO 98/04871 is to be considered as a generic raised-level built-in cooking appliance. The wall oven has a cooking space or an oven chamber, which is enclosed by side walls, a front, back and top wall, and has a bottom oven chamber opening. The wall oven is to be attached to a wall by its rear wall in the manner of a hanging cupboard. The bottom oven chamber opening can be closed by a lowerable bottom door. The bottom door is connected to the housing via a bottom door guide mechanism. By means of the bottom door guide the bottom door can be pivoted through a lift path.

SUMMARY OF THE INVENTION

It is accordingly an object of the invention to provide a raised-level built-in cooking appliance, which overcomes the disadvantages of the heretofore-known devices and methods of this general type and which reliably prevents the jamming of objects when the bottom door of the raised-level built-in cooking appliance is lowered.

With the foregoing and other objects in view there is provided, in accordance with the invention, a wall-mounted cooking appliance, comprising:

- a housing formed with a muffle and a bottom muffle opening;
- a lowerable bottom door for selectively closing said bottom muffle opening;
- a drive mechanism for hoisting said bottom door; and
- a control device configured to detect an angle of inclination of said bottom door and, in dependence on the angle of inclination, to control said drive mechanism to reduce the angle of inclination.

In other words, the objects of the invention are achieved with the novel raised-level built-in cooking appliance that has a control device, which detects an angle of inclination of the bottom door and controls the drive mechanism, depending on the magnitude of the angle of inclination, to reduce the angle of inclination. According to the present invention use is made of the fact that the bottom door tilts out of its normally horizontal position into a slightly oblique position, when its underside comes to bear on an object inadvertently placed under the bottom door, a cooking container for example, during the lowering procedure. In the process it adjusts the above-mentioned angle of inclination of the bottom door.

Angle sensors, which monitor the angle setting of the bottom door, can be employed to detect the angle of inclination. Alternatively, according to a preferred embodiment the magnitude of tensile forces can be detected by at least two tensile elements connected to the bottom door. Depending on a tensile force difference between the detected tensile forces the control device determines the angle of inclination of the bottom door.

The abovementioned tensile force difference can be determined for example by means of at least a first and a second switch. These switches generate switch signals when there is a change in the tensile forces in the at least two tensile elements. The control device compares corresponding switch signals of both switches and deduces the tensile force difference.

In a further advantageous embodiment of the invention the lowering procedure of the bottom door can always be terminated by means of the control mechanism whenever the detected tensile force falls below a certain threshold value. This is the case when the bottom door comes to bear on a working plate or another object positioned under the bottom door.

In addition, the control mechanism can also interrupt the bottom door drive if an upper threshold value of the tensile force is exceeded. This is the case whenever the bottom door comes against an upper stop, for example against the floor-side muffle opening in the cooking appliance housing.

The abovementioned tensile force difference can be determined for example by means of at least a first and a second switch. These switches generate switch signals when there is a change in the tensile forces in the at least two tensile elements. The control device compares corresponding switch signals of both switches and deduces the tensile force difference.

Other features which are considered as characteristic for the invention are set forth in the appended claims.

Although the invention is illustrated and described herein as embodied in a raised-level built-in cooking appliance, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIG. 5 is a perspective schematic view, in which a drive mechanism of the raised-level built-in cooking appliance is raised;

DESCRIPTION OF THE PREFERRED EMBODIMENTS

Figure 1:
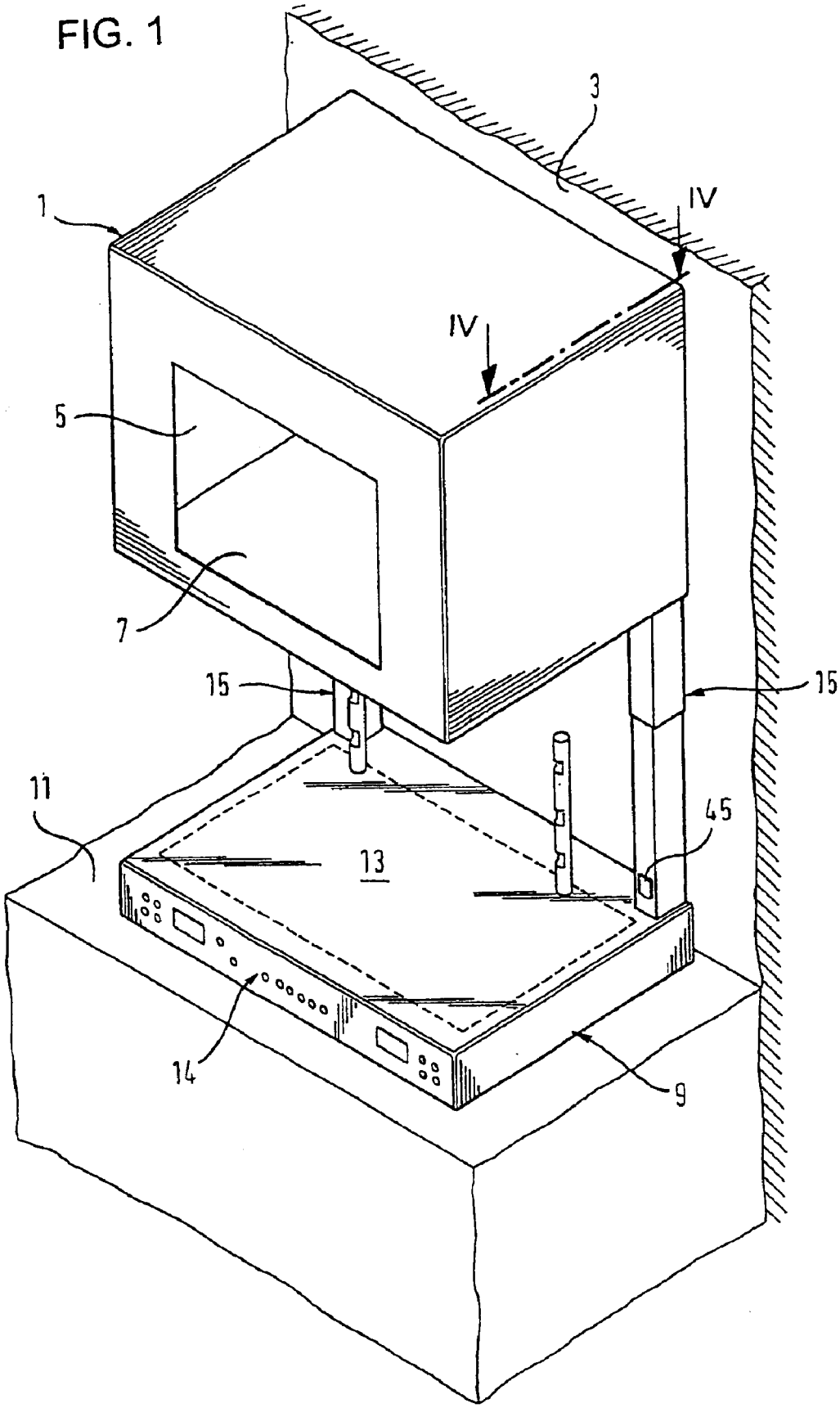
FIG. 1 is a perspective view of a raised-level built-in cooking appliance mounted on a vertical wall, with lowered bottom door.

Referring now to the figures of the drawing in detail and first, particularly, to FIG. 1 thereof, there is shown a raised-level, built-in cooking appliance, also referred to as a wall-mounted oven, with a housing 1. The rear side of the housing 1 is mounted on a vertical wall 3 in the manner of a hanging cupboard. In the housing 1 a muffle 5 delimits a cooking space, which can be monitored through a viewing window set in the front face into the housing 1. The term muffle 5 is herein used in its widest sense, as a heating or cooking chamber. The muffle 5 is fitted with a non-illustrated heat-insulating sheathing, and it has a bottom muffle opening 7. The muffle opening 7 can be closed with a lowerable bottom door 9. In FIG. 1 the bottom door 9 is shown in a lowered state, in which it lies with its underside on a work surface 11, or sill plate, or countertop, of a kitchen appliance. A cooktop 13 is provided on a top side of the bottom door 9 facing the muffle opening 7. The cooktop 13 is actuated via a control panel 14, provided on the front side of the bottom door 9.

Figure 2:
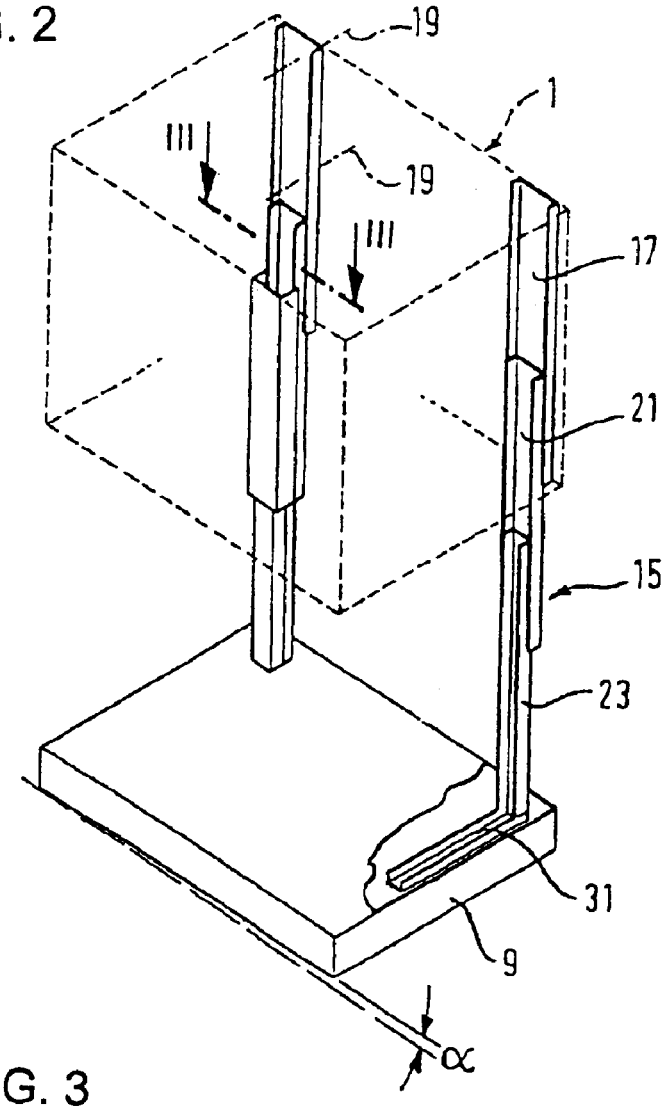
FIG. 2 is a perspective schematic view, in which a bottom door guide mechanism of the raised-level built-in cooking appliance is raised.

As is evident from FIG. 1, the housing 1 is connected via a bottom door guide mechanism 15 to the housing 1. The bottom door guide mechanism is constructed as a telescopic guide mechanism, by means of which the bottom door 9 is guided over a lift path, which is limited by the housing 1 and the sill plate 11. For this the telescopic guide mechanism 15 has on both sides of the raised-level built-in cooking appliance a first guide rail 17 fixed to the housing 1 and a second guide rail 23 fixed on the bottom door 9, as shown in FIG. 2. The two guide rails 17 and 23 are connected to one another via a middle rail 21 to move longitudinally.

As illustrated in FIG. 2, the first guide rail 17 is mounted inside the housing 1 indicated by dashed lines via a screw connection 19 on the housing rear wall. The middle rail 21 can move longitudinally with the bottom door-side guide rail 23 in a sliding connection. In FIG. 2 the topside of the bottom door 9 is shown partially raised. From this it is apparent that the guide rail 23 is designed as an L-shaped carrier, whereof the horizontal carrier leg 31 engages in the bottom door 9 in order to support the latter.

Figure 3:
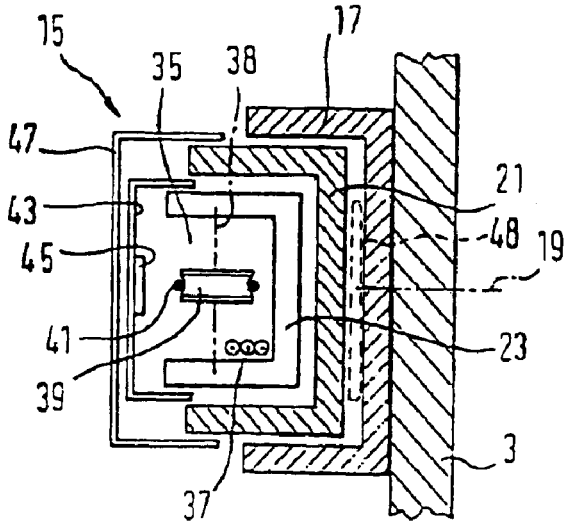
FIG. 3 is an enlarged view of a section taken along the line III—III of FIG. 2.

Referring now to FIG. 3, there is illustrated an enlarged sectional view along line III—III in FIG. 2. The guide rails 17, 23 and the middle rail 21 are rigid, U-profile parts that are resistant to bending and that can be telescoped into one another. The bottom door-side guide rail 23 is guided in the middle rail 21, while the middle rail 21 is displaceably mounted in the housing-side guide rail 17. When the bottom door 9 is closed, the housing-side guide rail 17 is thus arranged in the telescopic bottom door guide mechanism 15. In this way the outermost guide rail 17 can be mounted simply on the housing rear wall. The rails are preferably mounted by way of ball bearings, roller bearings, or cylinder bearings with balls, rollers, or cylinders taken up in bearing cages 48. One such bearing 48 is diagrammatically indicated between the rails 17 and 21.

The U-shaped rails 17, 21, 23 form a channel 35 according to FIG. 3. Electric supply or signal lines 37 are laid in the channel 35, for connecting the cooktop 13 and the control panel 14 in the bottom door 9 to control devices in the housing 1. Arranged in the channel 35 also is a deflection sheave 39 swivel-mounted about a axis of rotation 38. A pull rope 41 of a drive mechanism, yet to be described, of the raised-level built-in cooking appliance is guided in the manner of a lifting pulley about this deflection sheave 39. The channel 35 open to the left is covered by grooved shutters 43, 47. When the bottom door 9 is lowered the operator cannot see into the channel 35. The shutter 43 is assigned to the mobile guide rail 23 and is fastened detachably to its side walls. In similar fashion the shutter 47 is assigned to the middle rail 23. The shutters 43, 47 can be telescoped into one another corresponding to the rails 21, 23. When the bottom door 9 is closed the shutter 43 is thus arranged inside the shutter 47. Provided on a front side of the shutter 43 is an infrared sensor 45 for non-contact temperature measuring of a cooking container arranged on the cooktop 13.

Figure 4:
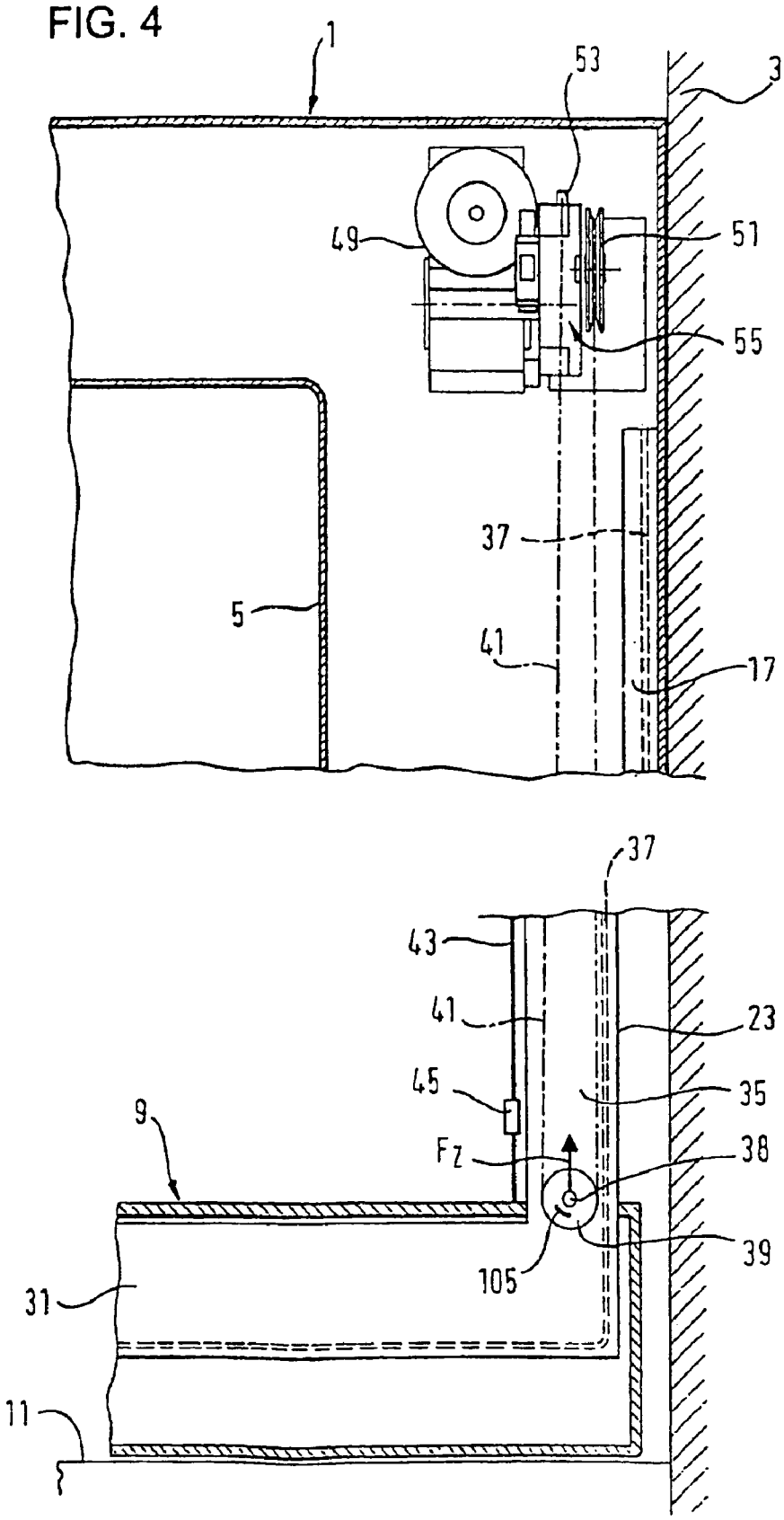
FIG. 4 is a side elevation enlarged in sections along the line IV—IV of FIG. 1.

On an enlarged scale FIG. 4 illustrates sections from a sectional view along line IV—IV in FIG. 1. An electromotor 49 is arranged in the interior of the housing 1. The motor 49 forms a drive mechanism. The electromotor 49 is driven by the control panel 14 provided at the front on the bottom door 9 via current or signal lines 37 (cf. FIG. 3). The lines 37 run inside the conduit 35 configured in the guide and middle rails 17, 21, 23. As apparent from FIG. 5, the electromotor 49 is arranged in the region of the housing rear wall approximately equidistant in the middle between the two side walls of the housing 1. The housing 1 is strongly outlined in FIG. 5 with dashed lines. FIG. 5 also demonstrates that the electromotor 49 is assigned tensile elements 41*a*, 41*b*. The tensile elements 41 are pull ropes in the present embodiment which, starting out from the electromotor 49 are first guided horizontally to laterally disposed housing-side deflection sheaves 51, and are then guided in a substantially vertical direction to a bottom door 9, indicated by dashed lines. The above-mentioned deflection sheaves 39 are mounted in the bottom door-side guide elements 23. The pull ropes 41*a*, 41*b* are guided in the manner of a lifting pulley around the bottom door-side deflection sheaves 39 and run once more in the housing 1. The ends 53 of the pull ropes are fixed in place on switching elements 55*a*, 55*b* fastened on the housing side. According to FIG. 5 the latter are arranged in the housing 1 at approximately the same height as the housing-side deflection sheaves 51. The construction and the operation of the switching elements 55*a*, 55*b* will now be described below.

Figure 6:
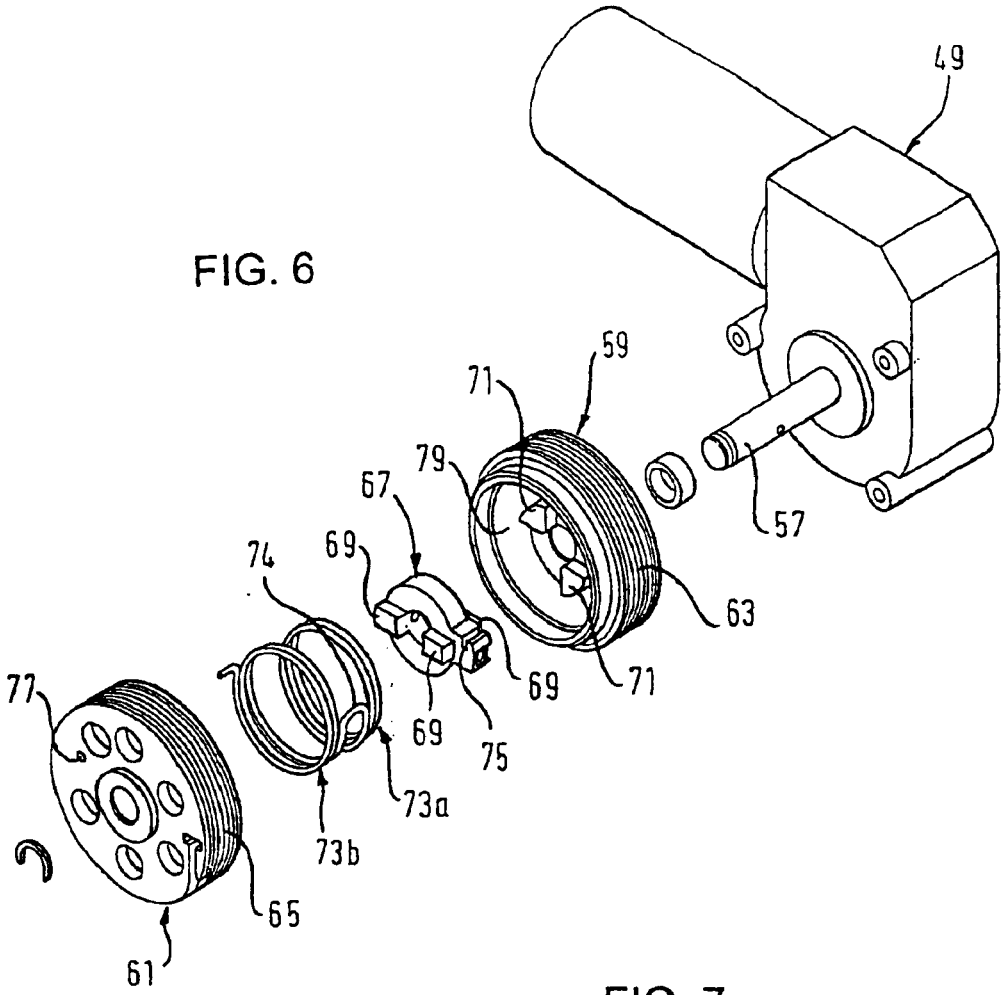
FIG. 6 is a perspective exploded view of an electromotor of the drive mechanism.
Figure 7:
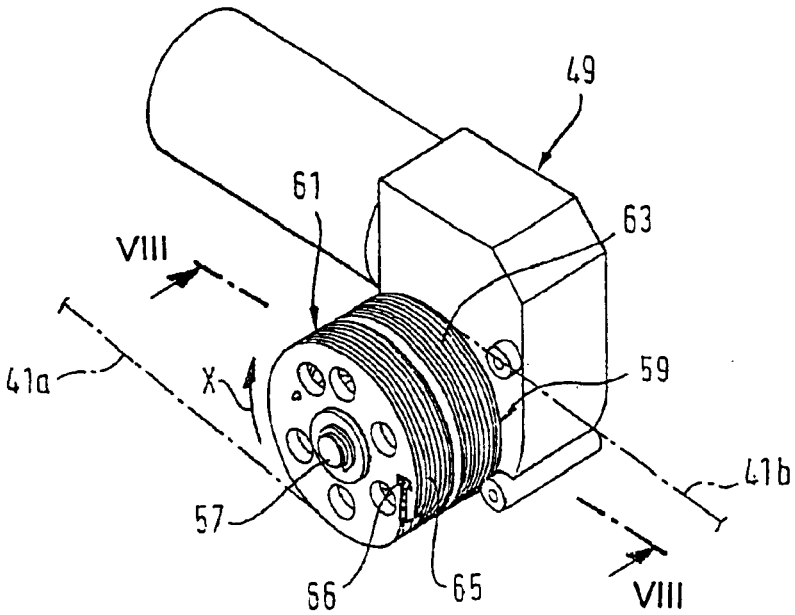
FIG. 7 is a perspective illustration of the assembled electromotor.

FIGS. 6 and 7 show the electromotor 49 for the pull ropes 41 in perspective in an exploded view and in the assembled state. The electromotor 49 has a driven shaft 57, on which two winding drums 59 and 61 are mounted, as shown in the perspective view according to FIG. 7. Depending on the direction of rotation of the driven shaft 57 each winding drum 59, 61 winds the assigned pull rope 41*a*, 41*b* up or down. For this purpose the winding drums 59, 61 are fitted with left-handed and right-handed rope grooves 63 and 65. The ends 67 of the pull ropes 41*a*, 41*b* are held firmly on the winding drums 59 and 61. FIG. 7 has a direction of rotation X of the driven shaft 57 indicated in a clockwise direction. In this case both the pull ropes 41*a*, 41*b* are unwound from their assigned winding drums 59, 61. The bottom door 9 accordingly descends. With rotation of the driven shaft 57 in an anticlockwise direction each rope pull 41*a*, 41*b* is wound onto its assigned winding drum. As is further evident from FIG. 6, a disc-like carrier 67 is attached to the driven shaft 57. The carrier 67 has carrier teeth 69 on both its opposite front sides. With rotation of the driven shaft 57 flanks of these carrier teeth 69 press on corresponding front teeth 71 of the winding drums 59, 61. The carrier teeth 69 of the carrier 67 work as swing angle stops. Each of the winding drums 59, 61 can be swivelled through a swing angle of approximately 90° between these swivel stops. Also, between the carrier 67 and each of the winding drums 59, 61 a coil spring 73*a*, 73*b* is tensed. In terms of process technology both coil springs 73*a*, 73*b* are connected to one another at one spring end via a pin 74, according to FIG. 6. The coil springs 73*a*, 73*b* are supported by their common spring pin 74 on the one hand in a locking groove 75 of the carriers 67. On the other hand the coil springs 73*a*, 73*b* are supported by their other spring ends in openings 77 of the winding drums 59 and 61.

As evident from FIG. 7, the winding drums 59 and 61 are mounted coaxially face to face and they are swivel-mounted relative to one another. At the same time both winding drums 59, 61 delimit a take-up space 79. The carrier 67, the radial teeth 71 of the winding drums and the springs 73*a* and 73*b* are housed economically in the take-up space 79.

Figure 8A:
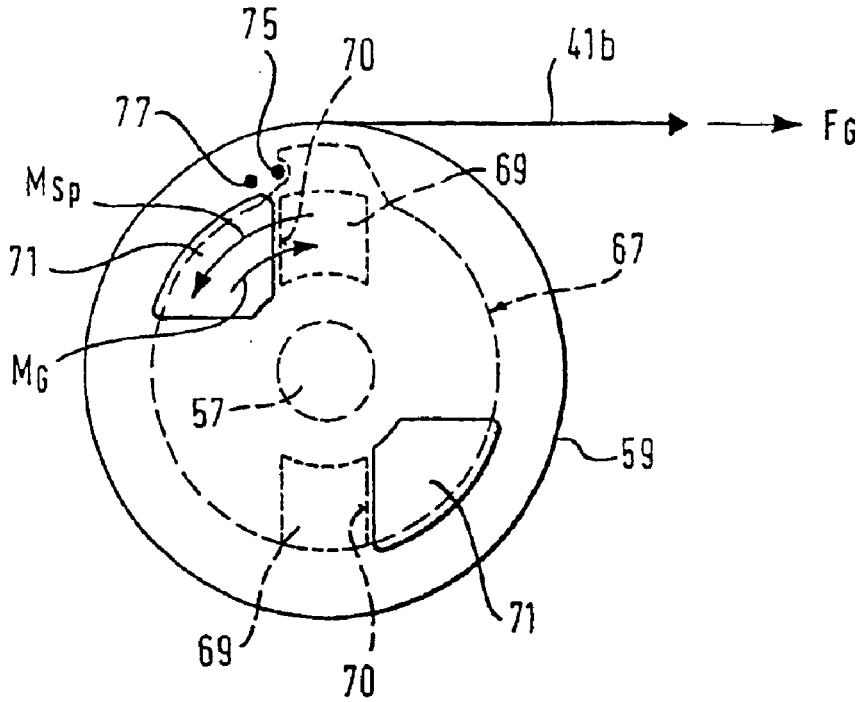
FIGS. 8A and 8B are schematic sectional views taken along the line VIII—VIII of FIG. 7.

The configuration described with reference to FIGS. 6 and 7 acts as a slack rope safety assembly for the pull ropes 41*a*, 41*b*. The operation of the slack rope safety assembly will now be described hereinbelow with reference to FIGS. 8A and 8B: according to FIG. 8B the pull rope 41*b* is tensed by the weight $F_G$ of the bottom door 9. A torque $M_G$ acts on the winding drum 59 in a clockwise direction. The torque $M_G$ presses the radial teeth 71 of the winding drum 59 onto first flanks 70 of the carrier teeth 69. Thus the winding drum 59 is held firmly with the carrier 67. Depending on the direction of rotation of the driven shaft 57 the carrier 67 of the winding drums can rotate in a clockwise or in an anticlockwise direction. In the state according to FIG. 8A the coil spring 73*a* supported between the points 75 and 77 is pre-tensed. The coil spring 73*a* thus exerts tension torque $M_{Sp}$ countering the torque $M_G$ on the winding drum 59.

Figure 8B:
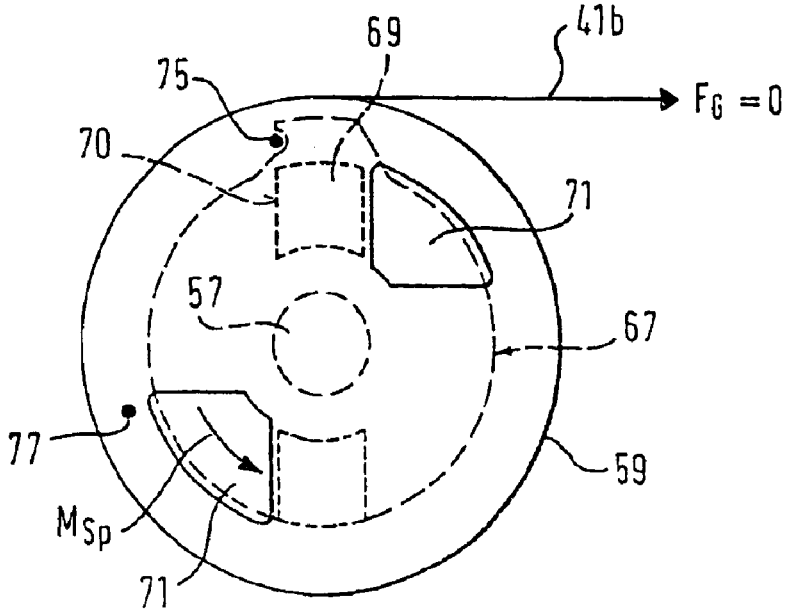

In FIG. 8B a mode is illustrated, which is attained if the bottom door 9 comes to rest for example on the sill plate 11 onto which it descends to a stop. In such a case, as is described hereinbelow, switching elements 55*a*, 55*b* are first activated. These send corresponding switch signals to a control device 103, which switches off the electromotor 49. Due to the signal path between the switching elements 55*a*, 55*b* and the electromotor 49, and on account of mass reactance effects the electromotor 49 is switched off with a time delay only after the switch signals are triggered. The consequence of the after-running of the electromotor 49 inside this time delay is that the weight of the bottom door 9 is taken up by the sill plate 11 and the pull rope 41*b* is relieved. Accordingly also the torque $M_G$ exerted on the winding drum 59 is reduced. Such pull relief is prevented by the tension torque $M_{Sp}$. The tension torque $M_{Sp}$ acts in an anticlockwise direction on the radial teeth 71 of the winding drum 59. The winding drum 59 is adjusted in relation to the driven shaft 57 in an anticlockwise direction and thus slackens the pull rope 41*b*. A minimum value of the tensile force in the pull rope 41*b* is maintained, such that slackening of the pull rope 41*b* is prevented.

Figure 9:
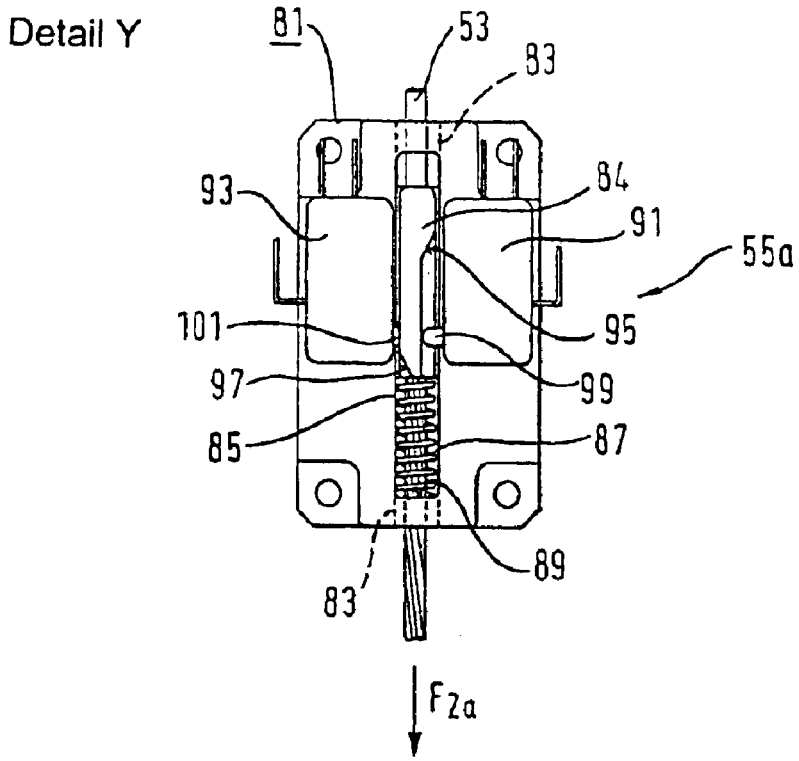
FIG. 9 is a detail Y of FIG. 5 in an enlarged front elevation.

With reference to FIG. 9, the construction and operation of the above-mentioned switching elements 55*a*, 55*b* will now be described with an exemplary view to the switching element 55*a* shown to the right in FIG. 5. The switching element 55*a* has a carrier plate 81 with a bore 83, through which the pull rope end 53 is guided. Attached to the pull rope end 53 is a switch lug 84, which protrudes through a switch window 85 placed on the front side of the carrier plate 81. The switch lug 84 is guided displaceably inside the switch window 85 and supported by a spring 87 on a lower support 89 of the switch window 85. By means of the switch lug 84 switches 91, 93 arranged opposite one another on the carrier plate 81 are switched. For this purpose the switch lug 83 has two opposite switch ramps 95, 97, which are offset to one another in the pull rope longitudinal direction. Depending on the height position of the switch lug 93 the switch ramps 95, 97 switch switch pins 99, 101 of the switches 91, 3. The height position of the switch lug 93 depends on the magnitude of the tensile force $F_{Za}$, with which the switch lug 83 presses on the spring 87. With activation of the switch pins 99, 101 switch signals $S_{a1}$, $S_{a2}$ are generated in the switches 91, 93 of the switching element 55*a*, which are transmitted to a control device 103 according to the block diagram in FIG. 10. Depending on these switch signals the control device 103 controls the electromotor 49.

Figure 10:
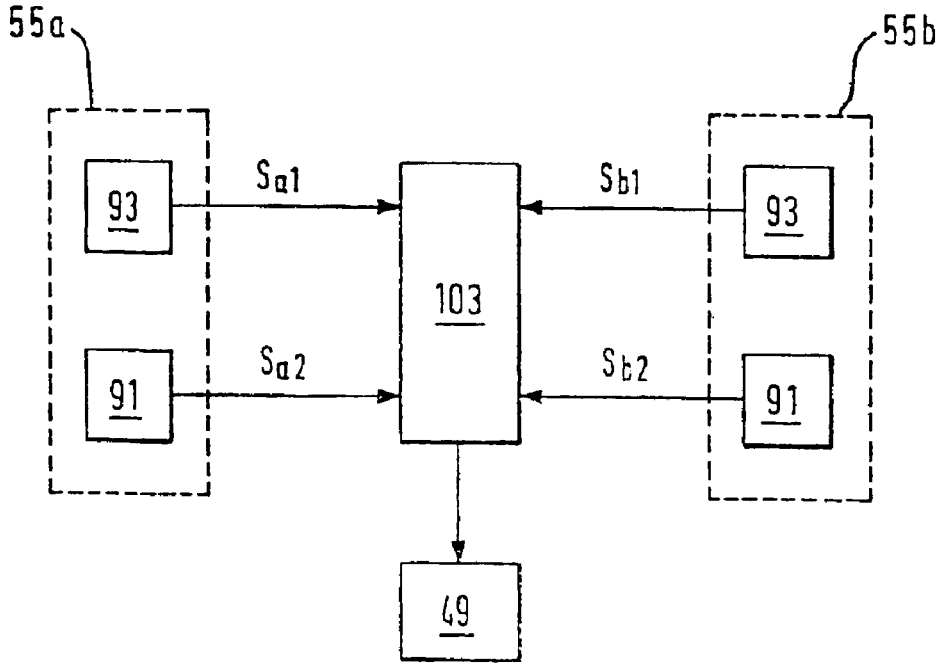
FIG. 10 is a block diagram illustrating a signal sequence to a control device according to the invention.

In FIG. 9 the left switch pin 101 of the switch 93 is activated by the switch ramp 97. This is the case according to the present invention whenever the value of the tensile force $F_{Za}$ is greater than or identical to a minimum value of the tensile force. This minimum value corresponds approximately to a value of the tensile force in a non-weight-loaded bottom door 9. In the event that a non-weight-loaded bottom door 9 goes against a lower stop, for example against the sill plate 11 or against an object lying on the sill plate, the pull rope 41*a* is relieved. The tensile force $F_{Za}$ in the pull rope 41*a* thus drops below the minimum value. In the process the switch ramp 97, to the left according to FIG. 9, shifts up and disengages from the switch pin 101. As shown in FIG. 10, the control device 103 thus receives a corresponding switch signal $S_{a1}$ from the switch 93 to switch off the electromotor 49.

The right switch pin 99 in FIG. 9 is shown disengaged from the right switch ramp 95. This is the case if the value of the tensile force $F_{Za}$ is less than a maximum value of the tensile force $F_{Za}$. This maximum value corresponds for example to a tensile force $F_{Za}$, which is adjusted with preset maximum dead-weight loading of the bottom door 9. The value of the tensile force $F_{Za}$ can exceed the maximum value, if the bottom door 9 is overloaded or if the bottom door 9 goes against an upper stop when the cooking space 3 is sealed off, for example against a bottom muffle flange of the muffle 5. In such a case the tensile force rises. The switch lug 84 is pressed down against the spring 87. This engages the right switch ramp 95 with the switch pin 99. The control device 103 now receives a corresponding switch signal Sa2 from the switching element 55*a* to switch off the electromotor 49. The operation described with respect to the switching element 55*a* applies identically for the switching element 55*b*, in FIG. 5 arranged on the right side of the housing 1. According to FIG. 10 the right switching element 55*b* forwards corresponding switch signals $S_{b1}$ and $S_{b2}$ to the control device 103.

The inventive control device 103 detects a time delay $\Delta t$ between corresponding switch signals $S_{a1}$ and $S_{a2}$ and between $S_{b1}$ and $S_{b2}$ of the switching elements 55*a*, 55*b*. This time delay $\Delta t$ results, for example, if the bottom door comes to bear on an object as it descends, for example a cooking container arranged underneath the bottom door 9. In such a case the bottom door 9 tilts out of its normally horizontal position into a slight oblique position. Such an oblique position of the bottom door 9 is indicated in FIG. 2. Accordingly the bottom door 9 is tilted at an angle of inclination $\alpha$ out of its horizontal position. The effect of the oblique position is that the pull ropes 41*a*, 41*b* are loaded by tensile forces $F_{Za}$, $F_{Zb}$ of varying magnitude. Here the tensile forces $F_{Za}$, $F_{Zb}$ do not drop below the lower threshold value. As a consequence the switches 99 and 101 of the switching elements 55*a*, 55*b* are switched in time delay of Δt. Corresponding switch signals $S_{a1}$ and $S_{b1}$ are thus generated likewise time-delayed. If the time delay between the switch signals $S_{a1}$ and $S_{b1}$ is greater than a value stored in the control device 103, for example 0.2s, then the control device 103 reverses the electromotor 49. The bottom door 9 is then raised to lessen the angle of inclination α.

Unintentional pinching of human body parts is prevented by the above-mentioned detection of the angle of inclination α of the bottom door and control of the electromotor 49 depending on the size of the angle of inclination α, in particular when the bottom door 9 descends.

Figure 11:
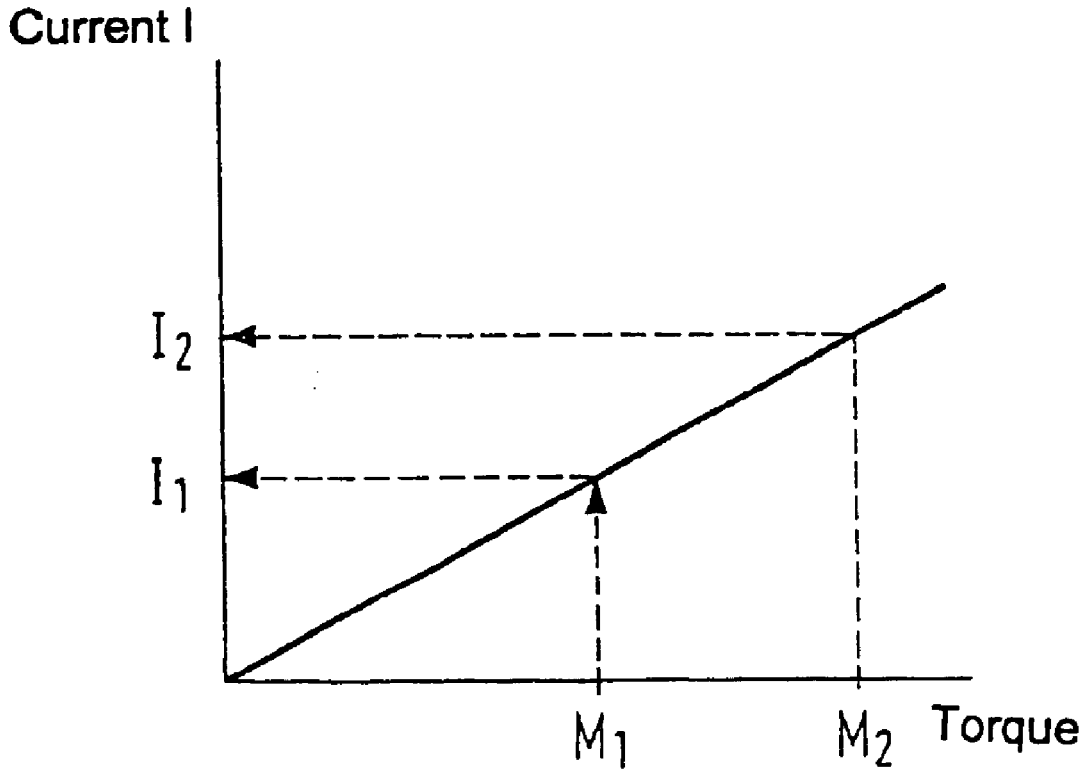
FIG. 11 is a loading diagram of the electromotor of the drive mechanism.

The electric current recorded by the electromotor 49 is detected to determine a dead-weight loading of the bottom door 9 according to the present invention, by means of the control device 103. Here the fact is employed that the current I recorded by the electromotor 49 behaves proportionally to a load torque, which lies on the driven shaft 57 of the electromotor 49. This connection is illustrated in a loading diagram according to FIG. 11.

At least two lift procedures are required to detect the weight of a cooking container set on the bottom door 9. In the first lift procedure the control device 103 first detects a current value $I_1$ for a load torque $M_1$ as a reference value. The load torque $M_1$ is exerted on the driven shaft 57 and is necessary to raise the non-weight-loaded bottom door 9. The current value $I_1$ is stored by the control device 103. In the subsequent second lift procedure the current value $I_2$ is detected for a load torque $M_2$, which is required for raising the weight-loaded bottom door 9. Depending on the magnitude of the differential values $(I_2-I_1)$ the control device 103 determines the dead-weight loading of the bottom door 9.

The current requirement of the electromotor 49 is influenced by the level of the temperature in the electromotor 49. In order to even out this influence it is advantageous to arrange a temperature sensor 105 in the electromotor 49, as indicated in FIG. 5. This is connected to the control device 103. Depending on the temperature measured on the temperature sensor 105 the control device 103 selects corresponding corrective factors. By means of these corrective factors the temperature influence is equalized to the current consumption of the electromotor.

To avoid an influence of temperature on the weight detection the dead-weight loading of the bottom door 9 can be detected according to the tensile force sensor 107 indicated in FIG. 5. The sensor 107 is in signal connection with the control device 103 and is assigned to the axis of rotation 38 of the deflection sheave 39. In a lift procedure the pull rope 41 exerts a tensile force $F_Z$, as shown in FIG. 5, on the tensile force sensor 107. Depending on the magnitude of the tensile force $F_Z$ on the bottom door 9 the tensile force sensor 107 generates signals, which are transmitted to the control device 103.

The signal of the tensile force sensor 107 can also be used, depending on the magnitude of the tensile force, to control the electromotor 49. If the value of the tensile force measured by means of the tensile force sensor is below a lower threshold value stored in the control device 103, the electromotor 49 is then switched off. If the tensile force sensor 107 detects a value of the tensile force, which is above an upper threshold value of the tensile force, then the electromotor 49 is likewise switched off.

The tensile force sensor 105 can alternatively be replaced by a torque sensor, which detects a load torque, which is exerted on the driven shaft 57 of the electromotor 49. Piezoelectric pressure sensors or deformation or tension sensors can also be employed as sensors for measuring the dead-weight loading, for example flexible stick-on strips or materials with tension-dependent optical properties and thus cooperating optical sensors.

In the exemplary description above and the attached figures, the sill plate 11 or work surface 11 acts as a lower end stop for the lowered bottom door 9. Alternatively, the end stop can also be provided by selection limiters in the telescopic rails 17, 21, 23. This enables any built-in height of the raised-level built-in cooking appliance on the vertical wall 3. The maximum lift path is achieved when the telescopic parts 17, 21 and 23 are fully extended from one another and the selection limiters prevent the rails from being separated.

I claim:

1. A wall-mounted cooking appliance, comprising:

a housing formed with a muffle and a bottom muffle opening;

a lowerable bottom door for selectively closing said bottom muffle opening;

a drive mechanism for hoisting said bottom door; and a control device configured to detect an angle of inclination of said bottom door and, in dependence on the angle of inclination, to control said drive mechanism to reduce the angle of inclination.

2. The wall-mounted cooking appliance according to claim 1, wherein said drive mechanism includes first and second drive means, and said first and second drive means are stressed with a first and a second tensile force, respectively, against a weight of said bottom door, and wherein said angle of inclination is detected via said first and second drive means by determining a tensile force difference between the first and second tensile forces.

3. The wall-mounted cooking appliance according to claim 2, which comprises a spring connected to and pre-tensing said first and second drive means, and wherein the first and second tensile force of each of said drive means is detected by measuring a deflection of said spring through a spring path caused by a change in the tensile force, and wherein said control device is configured to deduce the magnitude of the first and second tensile force in dependence on a magnitude of the spring path.

4. The wall-mounted cooking appliance according to claim 3, wherein each of said drive means has a respective end pre-tensed by said spring, and said pre-tensed end moves over the spring path.

5. The wall-mounted cooking appliance according to claim 2, wherein, for detecting the tensile force difference, said control device has at least a first switch and a second switch respectively generating a first and a second switch signal by shifting the first and second drive means, and said control device is configured to detect a time delay between generating the first and second switch signal and to fix the tensile force difference in dependence on a magnitude of the time delay.

6. The wall-mounted cooking appliance according to claim 5, wherein said control device is configured to reverse said drive mechanism when an upper threshold value of the time delay is undershot.

7. The wall-mounted cooking appliance according to claim 1, wherein said drive mechanism includes a tensile element carrying said bottom door and being stressed with a tensile force against a weight of said bottom door, and said control device is configured to interrupt said drive mechanism when the tensile force exceeds an upper threshold value of the tensile force.

8. The wall-mounted cooking appliance according to claim 1, wherein said drive mechanism includes first and second tensile elements carrying said bottom door and being stressed with first and second tensile forces, respectively, against a weight of said bottom door, and said control device is configured to interrupt said drive mechanism when an lower threshold value of at least one of the first and second tensile forces is undershot.

9. The wall-mounted cooking appliance according to claim 1, wherein said drive mechanism includes a tensile element carrying said bottom door and being stressed with a tensile force against a weight of said bottom door, and said control device is configured to reverse a direction of a lifting motion of said bottom door set by said drive mechanism when a lower threshold value of the tensile force is undershot.

* * * * *